US007959036B2

(12) United States Patent
Koh

(10) Patent No.: US 7,959,036 B2
(45) Date of Patent: Jun. 14, 2011

(54) ELASTOMERIC DISPENSING CONTAINER

(75) Inventor: Paul Koh, New York, NY (US)

(73) Assignee: Paul Koh, New York, NY (US)

( * ) Notice: Subject to any disclaimer, the term of this patent is extended or adjusted under 35 U.S.C. 154(b) by 303 days.

(21) Appl. No.: 11/701,203

(22) Filed: Feb. 1, 2007

(65) Prior Publication Data

US 2009/0200336 A1 Aug. 13, 2009

(51) Int. Cl.
*B65D 37/00* (2006.01)

(52) U.S. Cl. ..... 222/209; 222/215; 222/556; 222/568; 215/43; 215/45; 220/601; 220/645; 220/643; 220/640

(58) Field of Classification Search ..... 222/105, 222/107, 206, 209, 215, 556, 546, 154, 158, 222/494, 181.2, 181.3, 173, 179.5, 181.1, 222/185.1, 568, 212, 213; 215/43, 45; 220/601, 220/640, 643, 645

See application file for complete search history.

(56) References Cited

U.S. PATENT DOCUMENTS

| | | | | |
|---|---|---|---|---|
| 811,801 | A | 2/1906 | Smith | |
| 2,804,995 | A | 9/1957 | Fee | |
| 3,157,314 | A * | 11/1964 | Nadler | 222/88 |
| 3,219,220 | A * | 11/1965 | Hakim | 215/206 |
| 3,488,002 | A * | 1/1970 | Francis | 239/327 |
| 4,376,762 | A * | 3/1983 | Hauschild et al. | 424/49 |
| 5,301,840 | A * | 4/1994 | Sun | 222/109 |
| 5,339,995 | A * | 8/1994 | Brown et al. | 222/173 |
| 5,758,802 | A * | 6/1998 | Wallays | 222/212 |
| 5,992,662 | A * | 11/1999 | Holt et al. | 215/395 |
| 6,112,951 | A * | 9/2000 | Mueller | 222/490 |
| 6,427,874 | B2 * | 8/2002 | Brown et al. | 222/185.1 |
| 6,575,204 | B1 | 6/2003 | Godfrey | |
| 6,672,479 | B2 * | 1/2004 | Shiraishi et al. | 222/105 |
| 6,695,173 | B1 * | 2/2004 | Fontana | 222/212 |
| 6,705,492 | B2 * | 3/2004 | Lowry | 222/184 |

(Continued)

FOREIGN PATENT DOCUMENTS

| | | |
|---|---|---|
| DE | 202004014944 U1 * | 3/2005 |
| WO | 2005004788 | 1/2005 |

OTHER PUBLICATIONS

CUISIPRO Silicone Pastry Brush, available at www.amazon.com.

(Continued)

*Primary Examiner* — Kevin P Shaver
*Assistant Examiner* — Donnell Long
(74) *Attorney, Agent, or Firm* — Fitch, Even, Tabin & Flannery

(57) ABSTRACT

An elastomeric dispensing container for a fluid includes an elastomeric receptacle defining a chamber therein and having an integrally formed gasket extending radially from an opening formed on a lower end and a receptacle neck providing communications between the chamber and the opening, a relatively rigid sleeve disposed concentrically about the receptacle neck having a sleeve neck with a lower face adjacent to the integral gasket, a cap having a lid covering the receptacle opening and the integral gasket with a dispensing orifice formed therein and a cap neck extending from the lid disposed concentrically about the sleeve neck, and engaging means formed on the sleeve neck and the cap neck providing removable attachment therebetween wherein the engaging means secures the integral gasket in a compressed and substantially fluid-tight state between the lid and the sleeve lower face.

42 Claims, 4 Drawing Sheets

U.S. PATENT DOCUMENTS

| | | | | |
|---|---|---|---|---|
| 6,708,850 | B2 * | 3/2004 | Uetake et al. | 222/189.06 |
| 7,207,467 | B1 * | 4/2007 | Raja | 222/142.4 |
| 2002/0014499 | A1 * | 2/2002 | Bonningue | 222/185.1 |
| 2006/0243756 | A1 * | 11/2006 | Kawakita | 222/478 |
| 2007/0029352 | A1 * | 2/2007 | Norris et al. | 222/494 |
| 2007/0056964 | A1 * | 3/2007 | Holcomb | 220/4.03 |
| 2007/0114246 | A1 * | 5/2007 | Awbrey et al. | 222/181.2 |
| 2007/0272711 | A1 * | 11/2007 | Macleod et al. | 222/215 |
| 2007/0295354 | A1 * | 12/2007 | Costa | 132/308 |

OTHER PUBLICATIONS

ISI "Squid" Brush and Baster, available at www.amazon.com.

* cited by examiner

ELASTOMERIC DISPENSING CONTAINER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

This application relates broadly to containers for storing and dispensing fluids, specifically to such containers of the type utilizing an elastomeric receptacle and a dispensing cap.

Elastomeric containers, particularly in the form of elastomeric receptacles with dispensing caps, are commonly used for storing and dispensing fluids. A typical example is an oil cup of the type described in U.S. Pat. No. 811,801. To dispense the fluid, the receptacle is compressed to pressurize and expel the fluid through an orifice in the cap. The flexible yet resilient elastomeric receptacle provides a relatively easy to use, comfortable, precise, and powerful means to dispense the fluid, while also providing a convenient means to store the fluid. Typically manufactured through a molding process, the elastomeric receptacles can be formed in a variety of shapes and colors, and can include integrally molded features which can improve functionality without requiring additional parts.

Engagement between the receptacle and the cap is conventionally accomplished though a cylindrical neck formed on the receptacle engaged around a relatively rigid cylindrical neck on the cap. This method of attachment relies on a tight radial fit between the receptacle neck and the cap neck in order to create a substantially fluid-tight seal. However, the tight fit also often makes the cap difficult to attach and detach, which must typically be done regularly for purposes of cleaning, refilling, or the like. The receptacle neck sometimes further includes integrally formed annular beads or screw threads as means for attachment. However, these features formed on the elastomeric receptacle are often not rigid enough to provide secure attachment, and may also be prone to leakage. In an embodiment described in U.S. Pat. No. 811,801, a threaded metal extension is introduced between a threaded cap and an elastomeric receptacle to facilitate attachment and detachment of the cap. However, engagement between the extension and the sleeve still relies on the conventional method heretofore described. While cement is proposed to connect the receptacle to the extension, the use of cement is undesirable as it complicates assembly.

Accordingly, in addition to the objects and advantages described above, it is an object and advantage of the present invention to provide an elastomeric dispensing container comprising an elastomeric receptacle and a dispensing cap in secure and substantially fluid-tight engagement which also facilitates attachment and detachment of the cap. Further objects and advantages are to provide an elastomeric dispensing container that is easy and comfortable to use, convenient, and facilitates cleaning and refilling. Still further objects and advantages of my invention will become apparent from a consideration of the drawings and ensuing description.

SUMMARY

In accordance with the present invention an elastomeric dispensing container for a fluid comprises an elastomeric receptacle defining a chamber therein and having an integrally formed gasket extending radially from an opening formed on a lower end and a receptacle neck providing communications between the chamber and the opening, a relatively rigid sleeve disposed concentrically about the receptacle neck having a sleeve neck with a lower face adjacent to the integral gasket, a cap having a lid covering the receptacle opening and the integral gasket with a dispensing orifice formed therein and a cap neck extending from the lid disposed concentrically about the sleeve neck, and engaging means formed on the sleeve neck and the cap neck providing removable attachment therebetween wherein the engaging means secures the integral gasket in a compressed and substantially fluid-tight state between the lid and the sleeve lower face.

DETAILED DESCRIPTION

Figure 1:
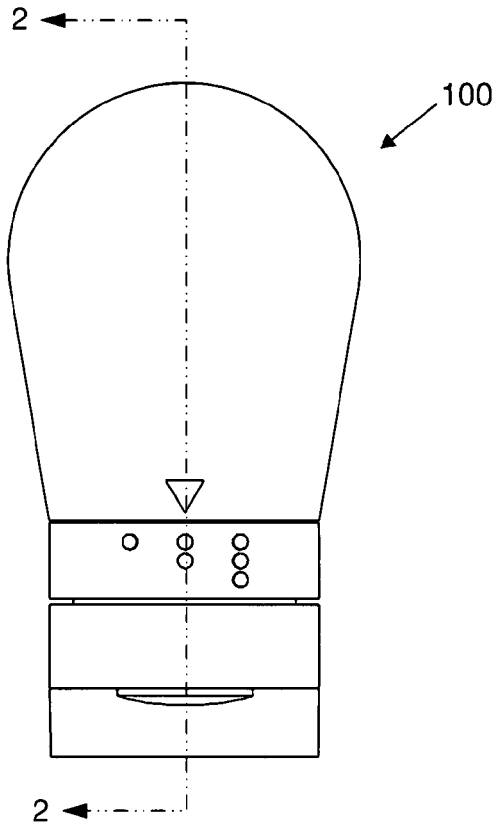
FIG. 1 is a front view of an elastomeric dispensing container.
Figure 2A:
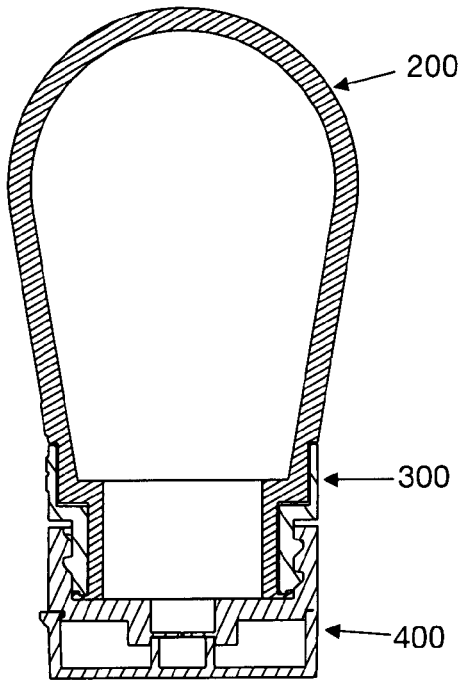
FIG. 2A is a side cross-sectional view of the container of FIG. 1, taken along line 2-2 in FIG. 1.
Figure 2B:
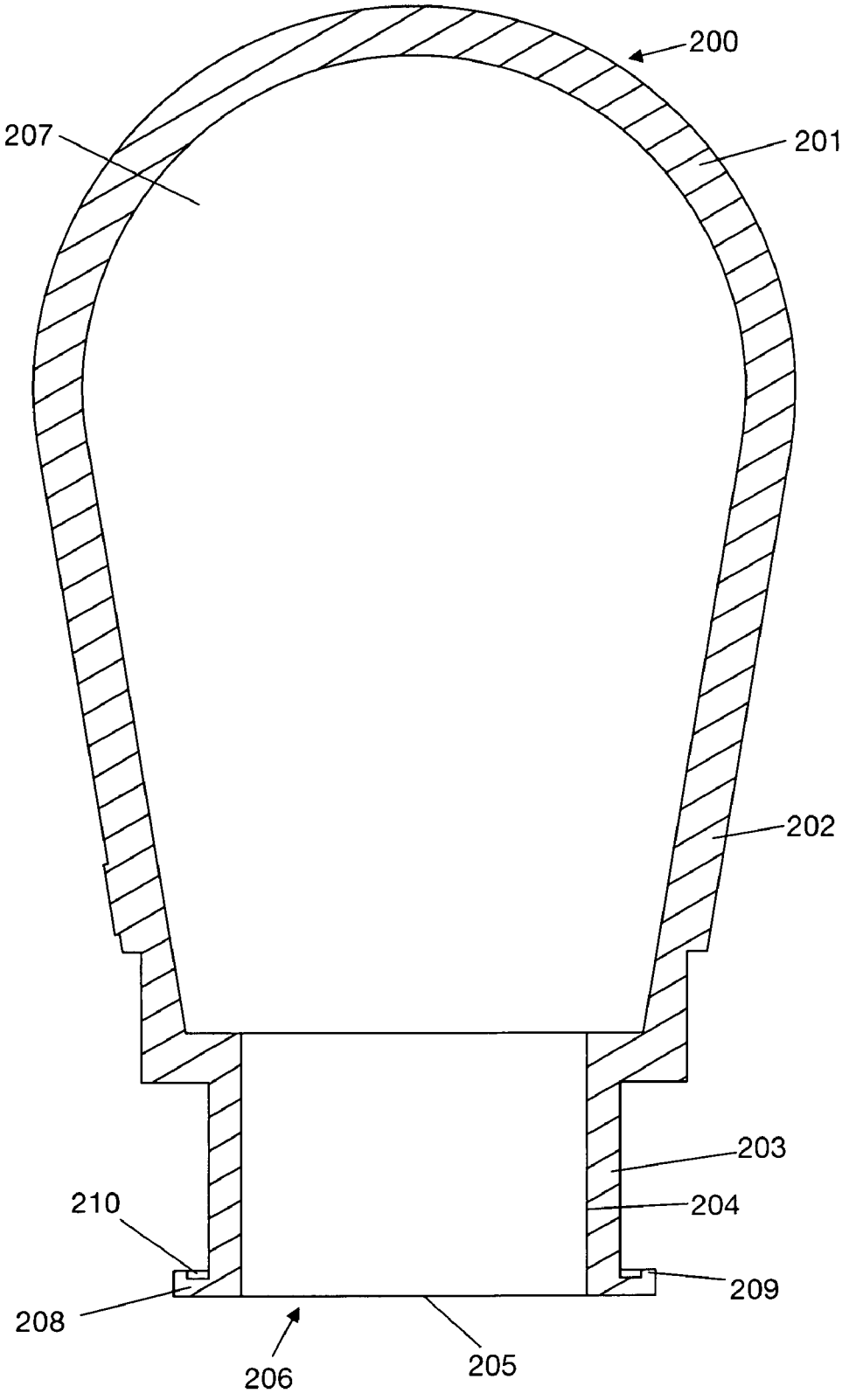
FIG. 2B is a side cross-sectional view of an elastomeric receptacle, taken along line 2-2 in FIG. 1.
Figure 2C:
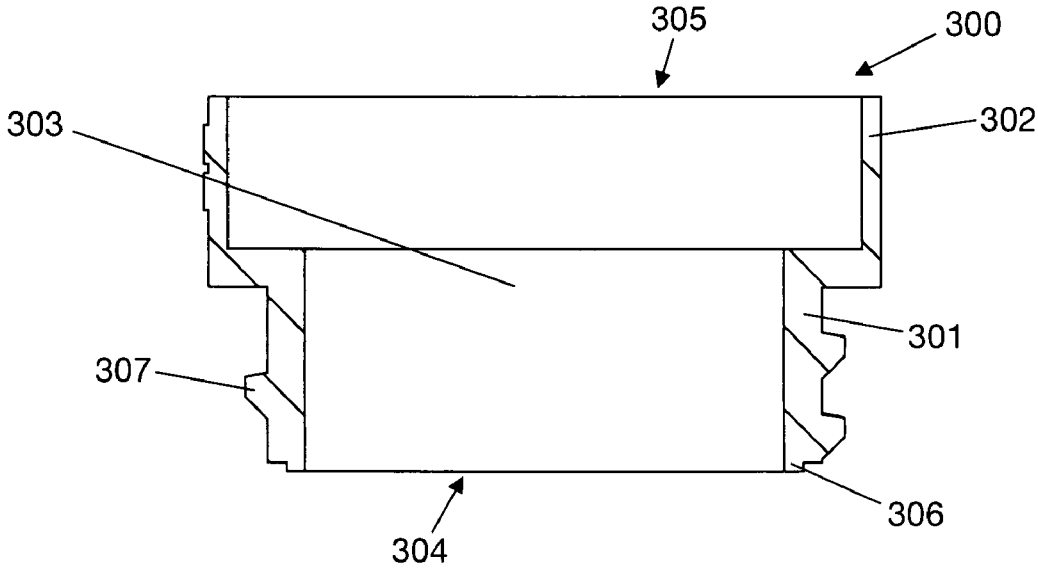
FIG. 2C is a side cross-sectional view of a relatively rigid sleeve, taken along line 2-2 in FIG. 1.
Figure 2D:
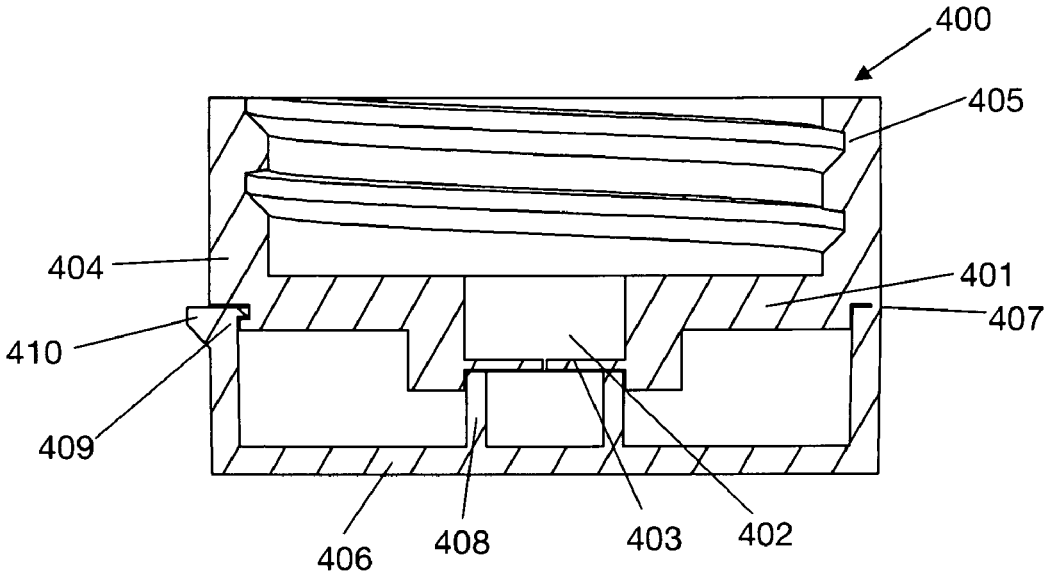
FIG. 2D is a side cross-sectional view of a dispensing cap, taken along line 2-2 in FIG. 1.
Figure 3:
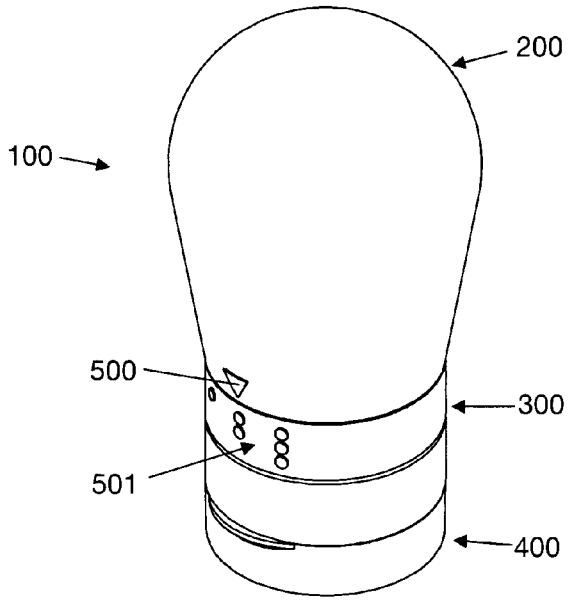
FIG. 3 is a perspective view of the container of FIG. 1.

A preferred embodiment of an elastomeric dispensing container 100 and its components are shown in FIGS. 1-3. The container 100 includes a flexible and resilient elastomeric receptacle in the form of a squeeze bulb 200, a relatively rigid sleeve 300, and a dispensing cap 400.

Referring to FIG. 2B, the squeeze bulb 200 has a main body 201 which is generally spherical in shape, passing into a tapered portion 202, passing into to a stepped cylindrical receptacle neck 203 with an inner diameter 204, and terminating in an opening 205 formed at a lower end 206. The inner diameter 204 is preferably of sufficient size to facilitate refilling and cleaning an inner chamber 207 defined within squeeze bulb 200. The receptacle neck 203 provides communication between the opening 205 and the chamber 207. An integral gasket 208 extends outwardly from the opening 205, and includes a circumferential rib 209 defining an annular retaining channel 210. The squeeze bulb 200 is formed of an elastomeric material, preferably silicone for its favorable mechanical properties and chemical inertness, although any other suitable elastomeric material could be used, such as the types sold under the trade names SANTOPRENE and KRATON. The elastomeric material is further preferably substantially light-transmitting to make visible a fluid contained in the squeeze bulb 200, and of an appropriate durometer, such as 40 Shore A, to make the squeeze bulb 200 substantially deformable yet resilient.

Referring to FIG. 2C, the sleeve 300 has a cylindrical sleeve neck 301 with a lower face 304, passing into a shoulder 302 with an upper face 305. An internal passage 303 is configured to receive and have a close, but rotationally free fit with the receptacle neck 203. The sleeve 300 further includes an annular retaining rib 306 formed on the lower face 304, where the retaining rib 306 is dimensioned to be received in the squeeze bulb retaining channel 210. An external thread 307 is formed on the sleeve neck 301, preferably of an industry-standard size, such as 33-400, so that a variety of readily available stock caps could be used. The sleeve 300 is formed of a relatively rigid material, such as polycarbonate, although any other suitable material could be used.

Referring to FIG. 2D, the dispensing cap 400 has a lid 401 which is dimensioned to cover the squeeze bulb opening 205 and the integral gasket 208. A dispensing orifice 402 is formed in the lid 401. A cross-cut silicone valve 403 is included within the orifice 402. A cap neck 404 extends upward from the lid 401, and includes an internal thread 405, where the cap neck 404 and the internal thread 405 are dimensioned to receive and engage the sleeve neck 301 and the sleeve external thread 307. The cap 400 further includes a cover 406 hingedly attached by a bi-stable living hinge 407 which holds the cover 406 away from the orifice 402 during dispensing. The cover 406 is configured to provide a stable base on which the container 100 can stand on a flat surface. The cover 406 includes an integrally formed plunger 408 which is positioned and dimensioned to seal the orifice 402 when the cover 406 is in a closed position. The cap 400 further includes a detent 409 and a protruding lip 410 formed on the cover 406. The cap 400 is preferably formed of a relatively rigid material, such as PP (polypropylene) plastic, which provides a high cycle life for the living hinge 407. While a preferred cap 400 has been described here, it is to be understood that any of a broad range of well known and readily available dispensing caps could also be used.

Referring to FIG. 3, an arrow 500 is formed on the squeeze bulb 200 adjacent to the sleeve shoulder 302 and a plurality of radially-spaced symbols 501 is formed on the sleeve shoulder 302.

Referring to FIGS. 2A-2D, in assembly, the sleeve 300 is first engaged to the squeeze bulb 200 by pushing the squeeze bulb lower end 206 through the sleeve internal passage 303. The integral gasket 208 and the receptacle neck 203 deflect inward to allow their passage though the sleeve neck 301. When fully engaged, the sleeve 300 is captured between the integral gasket 208 and the receptacle lower end 202, and the retaining rib 306 is fully seated in the annular channel 210. The cap 400 is attached by grasping the sleeve shoulder 302 to provide support, and then screwing on the cap 400 until the integral gasket 208 is compressed between the lid 401 and the sleeve lower face 304 and a secure and substantially fluid-tight engagement between the squeeze bulb 200 and the cap 400 has been created.

Referring to FIGS. 2A-2D, in operation, the squeeze bulb 200 filled through the opening 205 after unscrewing the cap 400. When the cap 400 is loosened, the bulb 200 and the sleeve 300 can be rotated relative to one another to align the arrow 500 to an appropriate selection from the symbols 501. When the cap 400 is fully engaged to the sleeve 200, friction provided by the compressed integral gasket 208 prevents relative rotational movement between the sleeve 300 and the squeeze bulb 200. After the cap 400 has been reattached, the container 100 can stand on the cover 406, such that gravity maintains the fluid near the orifice 402 so the fluid is more readily dispensed. To dispense the fluid, the cover 406 is opened by pushing on the lip 410 to overcome the detent 409, and the squeeze bulb 200 is compressed until a sufficient internal fluid pressure has been created to open the valve 403. When the pressure is released, the valve 403 closes immediately, preventing the fluid from dripping. To clean the interior of the container 100, the cap is detached by grasping the sleeve shoulder 302 for support and unscrewing the cap 400. A cleaning instrument, such as a user's finger, can then enter into the squeeze bulb 200 through opening 205.

Figure 4:
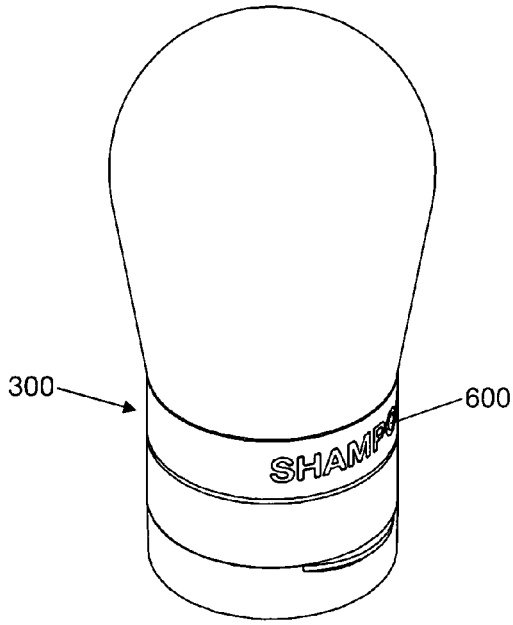
FIG. 4 shows a perspective view of an elastomeric dispensing container with alternate indicia.
Figure 5:
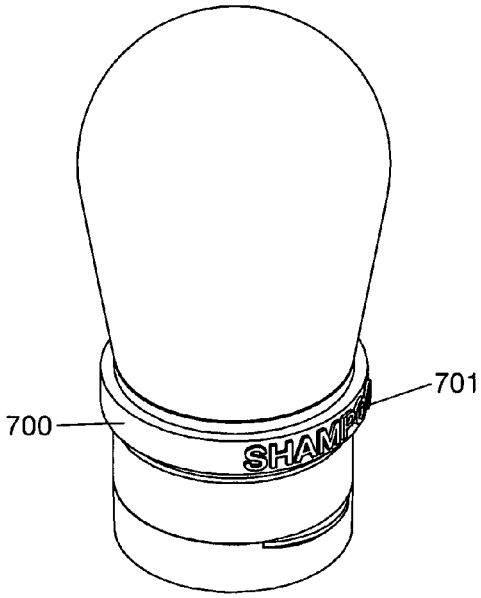
FIG. 5 shows a perspective view of an elastomeric dispensing container with alternate indicia.

FIG. 4 and FIG. 5 show alternate indicia for the contents of the container 100. In FIG. 4, a phrase 600 is formed on the sleeve shoulder 302. The phrase 600 can either be integrally molded on sleeve 300, or printed subsequent to molding. In FIG. 5, an elastomeric band 700 with an integrally formed phrase 701 is removably engaged to the sleeve shoulder 302, so that it can be easily replaced by an alternate band, depending on the contents. The band 700 also enhances a user's grip on the shoulder 302, aiding in attaching and detaching the cap 400.

Figure 6:
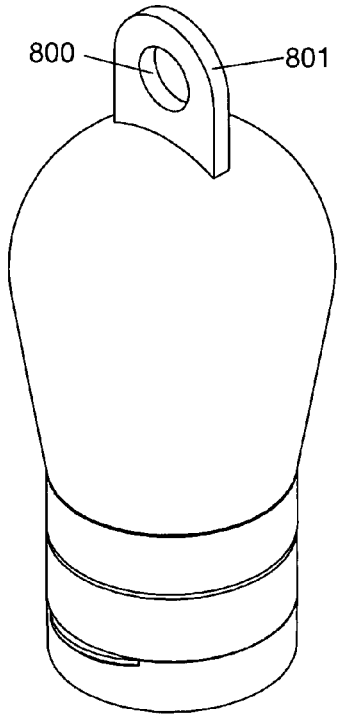
FIG. 6 shows a perspective view of an elastomeric dispensing container with an integrally formed hole.

Referring to FIG. 6, an alternate embodiment of the squeeze bulb 200 is shown where a hole 800 is formed on a flange 801 integrally formed on the squeeze bulb 200 to allow for convenient hanging of the container 100.

Thus it will be seen that the elastomeric dispensing container of the invention provides a secure, substantially fluid-tight engagement of the elastomeric receptacle 200 to the cap 400 while still facilitating attachment and detachment of the cap 400, and is also easy and comfortable to use, convenient, and facilitates cleaning and refilling.

Although illustrative embodiments of the present invention have been described herein with reference to the accompanying drawings, it is to be understood that the invention is not limited to those precise embodiments and methods and that various other changes may be effected herein by one skilled in the art without departing from the scope or spirit of the invention. For example, while specific materials, shapes, and indicia have been disclosed for the various parts of container 100, other materials, shapes, and indicia could be used. While a specific dispensing cap has been described, a variety of dispensing closures and nozzles could be used. Also, while an application involving a dispensing container has been described herein, the present invention may be applicable in other situations requiring fluid-tight attachment of a squeeze bulb, such as basting devices, or medical devices for extracting and discharging fluids.

Accordingly, the scope of the invention should be determined not by the embodiments illustrated, but by the appended claims and their legal equivalents.

The invention claimed is:

1. An elastomeric dispensing container for a fluid comprising:

a flexible and resilient receptacle composed of an elastomeric material defining a chamber therein;

opposite upper and lower ends of the receptacle with the receptacle having a central, longitudinal axis extending between the opposite ends thereof and a predetermined axial length of the receptacle between the opposite ends, an integral gasket of the receptacle extending radially from an opening formed at the receptacle lower end;

a receptacle neck extending up from the receptacle lower end for providing communications between the chamber and the opening, wherein the integral gasket and the receptacle are fabricated as a single piece from the elastomeric material, a discrete sleeve composed of a substantially rigid material and having opposite upper and lower ends, with the sleeve being disposed concentrically about the receptacle neck having a sleeve neck with a lower face at the sleeve lower end and which is disposed adjacent to the integral gasket, a cap having a lid covering the receptacle opening and the integral gasket with a dispensing orifice formed therein and a cap neck extending from the lid disposed concentrically about the sleeve neck, the cap having open and closed positions, engaging means formed on the sleeve neck and the cap neck providing removable attachment therebetween wherein the engaging means secures the integral gasket in a compressed and substantially fluid-tight state between the lid and the sleeve lower face; and a wall portion of the receptacle that is configured to be resiliently deformable and which has a predetermined, non-deformed configuration, the wall portion extending about the chamber and upwardly from the sleeve upper end to the receptacle upper end so that the entirety of the receptacle exposed above the substantially rigid sleeve is available to be compressed to pressurize fluid in the chamber for expelling the fluid from the receptacle chamber through the cap orifice with the cap in the open position and to allow air to be drawn into the receptacle chamber as the wall portion resiliently returns to the predetermined, non-deformed configuration thereof.

2. The container of claim 1, wherein the receptacle is configured as a flexible and resilient squeeze bulb.

3. The container of claim 1, further including sealing means for the orifice.

4. The container of claim 3, wherein the sealing means comprises a cover hingedly attached to the cap with an integrally formed plunger adapted to seal the orifice.

5. The container of claim 1, wherein the cap further includes standing means whereby the cap provides a stable base on which the container can stand on a flat surface such that a fluid contained in the receptacle is urged by gravity towards the dispensing orifice and is more readily dispensed.

6. The container of claim 5, wherein the standing means comprises a substantially flat surface formed on the cap normal to a longitudinal axis of the container.

7. The container of claim 1, further including indicia for a fluid contained in the receptacle.

8. The container of claim 7, wherein the indicia are formed on the receptacle and the sleeve, whereby rotation of the receptacle relative to the sleeve aligns the receptacle indicia to the sleeve indicia.

9. The container of claim 7, wherein the indicia are formed on an elastomeric band removably engaged to the container.

10. The container of claim 1, wherein the cap further includes valving means to regulate flow from the dispensing orifice.

11. The container of claim 10, wherein the valving means comprises a cross-cut elastomeric valve.

12. The container of claim 1, wherein the engaging means comprises screw threads.

13. The container of claim 1, wherein the sleeve further includes a shoulder which may be grasped to provide support while engaging the cap.

14. The container of claim 1 including an annular rib formed on the sleeve lower face and an annular channel formed on the integral gasket facing the sleeve lower face adapted to receive the annular rib.

15. The container of claim 1 wherein the receptacle includes a main elongated fluid holding portion that extends between the receptacle neck and the receptacle upper end, and the sleeve includes an upper annular portion radially offset from the sleeve neck and extending axially up therefrom along the receptacle main elongated fluid holding portion to the sleeve upper end.

16. The container of claim 15 wherein the receptacle neck has a predetermined axial length between the receptacle lower end and the receptacle main elongate fluid holding portion that is longer than a predetermined axial length of the sleeve upper annular portion between the sleeve neck and the sleeve upper end.

17. The container of claim 15 wherein the receptacle main elongated fluid holding portion has a transverse wall portion extending orthogonal to the longitudinal axis and disposed therealong such that the upper end of the sleeve upper annular portion is closely adjacent thereto.

18. The container of claim 17 wherein the receptacle main elongated fluid holding portion and the sleeve annular portion each have an outer surface thereof and the transverse wall portion is sized such that there is a substantially continuous transition between the outer surface of the receptacle main elongated fluid holding portion and the outer surface sleeve annular portion at the upper end thereof.

19. The container of claim 17 wherein the transverse wall portion has a width thereacross, and the sleeve annular portion has a thickness substantially corresponding to the transverse wall portion width.

20. The container of claim 1 wherein the cap includes a cover having a bottom flat surface that is sized to extend radially across and beyond the cap dispensing orifice and the receptacle lower opening a sufficient amount for providing stable support for the container with the cover bottom flat surface engaged on a flat support surface.

21. The container of claim 1 wherein the receptacle wall portion has a side wall portion extending upwardly from the sleeve upper end and an end wall portion extending upwardly from the side wall portion toward the receptacle upper end with the side wall portion having a compound curved configuration to increase the resiliency thereof for the resilient return of the receptacle wall portion to the predetermined, non-deformed configuration after being resiliently deformed.

22. The container of claim 21 wherein the end wall portion has a substantially convex configuration for ease in compression thereof to expel fluid from the chamber at or adjacent the receptacle upper end.

23. The container of claim 21 wherein the side wall portion having the compound curved configuration extends axially for more than a quarter of the predetermined axial length of the receptacle.

24. The container of claim 1 wherein the receptacle wall portion has a predetermined axial length from the sleeve upper end to the receptacle upper end, and the receptacle wall portion further includes opposite side tapered portions that are inclined relative to the receptacle longitudinal axis to taper between the sleeve upper end and the receptacle upper end for more than half the predetermined axial length of the receptacle wall portion.

25. The container of claim 24 wherein the opposite side tapered portions are inclined to taper radially outwardly away from each other as the opposite side tapered portions extend upwardly, and the receptacle wall portion has an upper, inwardly curved portion sized to extend upwardly and radially inwardly between the opposite side tapered portions and the receptacle upper end so that an upper cross-sectional area of the chamber adjacent the receptacle upper end across the radially inward curved portion is less than half of a lower cross-sectional area of the chamber adjacent the sleeve upper end and across lower ends of the opposite side tapered portions.

26. The container of claim 24 wherein the receptacle has a varying width thereacross orthogonal to the receptacle longitudinal axis such that the width across the opposite side tapered portions adjacent the sleeve upper end is less than the width across the opposite side tapered portions adjacent the receptacle upper end.

27. The container of claim 1 wherein the sleeve neck has an internal surface that has a smooth configuration which is free of threading thereon, and the receptacle neck has an external surface that has a smooth configuration which is free of threading thereon with the internal and external surfaces being further configured and sized so that the sleeve neck has a close, non-threaded fit with the receptacle neck.

28. The container of claim 15 wherein the sleeve upper annular portion has a constant outer diameter, and the cap has an outer annular portion having a constant outer diameter the same as the constant outer diameter of the sleeve upper annular portion.

29. The container of claim 28 wherein the cap includes a cover having a flat bottom wall that extends diametrically across a bottom circular end of the outer annular portion to stably support the container on a flat surface.

30. The container of claim 29 wherein the cap cover and the cap lid have a hinge connection therebetween and a diametrically opposite detent therebetween to allow the cap cover to be manually pivoted open and closed relative to the cap lid.

31. A squeeze container for holding fluids to be squeezed out therefrom, the squeeze container comprising:

a receptacle in which fluid is to be received and having upper and lower ends;

an opening of the receptacle at the lower end thereof;

an integral radially extending gasket of the receptacle at the receptacle lower end extending about the receptacle opening;

a substantially rigid sleeve extending around the receptacle adjacent the lower end thereof;

a lower end of the sleeve having the gasket protruding therefrom;

a resiliently deformable wall portion of the receptacle extending from the substantially rigid sleeve to the receptacle upper end for being squeezed to pressurize fluid in the receptacle;

a dispensing cap having a lid configured to be connected to the sleeve to extend across the receptacle opening;

a valve of the dispensing cap lid arranged so that with the cap connected to the sleeve the valve is aligned with the receptacle opening to allow fluid in the receptacle to be dispensed through the valve in response to squeezing of the receptacle wall portion;

a cover of the cap pivotally connected to the cap lid and having a sealing portion arranged and configured to cooperate with the valve to keep fluid in the receptacle with the cover pivoted to a closed position;

a flat bottom surface of the cover that allows the container to stand on a flat surface with the cover pivoted to the closed position and the sealing portion keeping fluid in the receptacle;

a detent between the cover and the lid to releasably keep the cover in the closed position; and a protruding lip of the cover configured for being engaged by a user to apply force to the cover sufficient to overcome the detent to pivot the cover to an open position to allow fluid in the receptacle to be dispensed through the valve in response to squeezing of the receptacle wall portion.

32. The squeeze container of claim 31 wherein the cover has an outer annular wall portion having an upper end, and the protruding lip projects radially outward from the upper end of the cover annular wall portion.

33. The squeeze container of claim 31 wherein the detent comprises a radially inward projection of the cover, and a corner wall portion of the lid having a groove formed therein into which the cover projection is releasably fit with an outer bottom portion of the corner wall portion in interference with the cover projection received in the groove to releasably hold the cover projection in the groove.

34. The squeeze container of claim 33 wherein the cover has an outer annular wall portion having an upper end, the protruding lip projects radially outward from the upper end of the cover annular wall portion, and the radially inward projection extends radially inward from the upper end of the cover annular wall portion in alignment with the protruding lip.

35. The squeeze container of claim 31 wherein the cover and lid have a bi-stable living hinge therebetween configured to keep the cover in the pivoted open position while fluid is dispensed through the valve in response to squeezing of the receptacle wall portion.

36. The squeeze container of claim 31 wherein the sleeve includes an outer annular wall portion having an outer diameter and the lid includes an outer annular wall portion having an outer diameter that is the same as the outer diameter of the sleeve outer annular wall portion.

37. The squeeze container of claim 36 wherein the cover includes an annular wall portion having an outer diameter that is the same as the outer diameters of the outer annular wall portions of the sleeve and the lid so that with the cover pivoted to the closed position, outer annular surfaces on the annular wall portions of the sleeve, the lid, and the cover are substantially flush with each other.

38. The squeeze container of claim 31 wherein the receptacle has a reduced diameter annular neck portion extending around the opening at the lower end thereof and having an outer smooth, thread-free surface, and the substantially rigid sleeve has an annular neck portion having an inner smooth, thread-free surface sized to have a close, thread-free fit with the outer smooth, thread-free surface of the receptacle annular neck portion.

39. A squeeze container for holding fluids to be squeezed out therefrom, the squeeze container comprising:

a receptacle for containing fluids therein and having upper and lower ends and longitudinal axis extending therebetween;

an opening of the receptacle at the lower end thereof;

a substantially rigid sleeve extending around the receptacle adjacent the lower end thereof;

a resiliently deformable wall portion of the receptacle extending from the substantially rigid sleeve to the receptacle upper end for being squeezed to pressurize fluid in the receptacle;

an outer, smooth annular surface of the receptacle adjacent the lower end thereof;

an inner, smooth annular surface of the sleeve sized to have a close and rotationally free fit about the receptacle outer, smooth annular surface to allow the sleeve to be rotated about the receptacle without axial travel therealong;

multiple indicia on one of the receptacle and the sleeve with each indicium being different and corresponding to different fluids that may be contained in the receptacle;

an indicator on the other of the receptacle and the sleeve arranged so that rotation of the sleeve about the receptacle allows a user to align the indicator with a selected one of the multiple indicia corresponding to the fluid contained in the receptacle;

a cap removably connected to the sleeve and having a valve that allows fluid in the receptacle to be dispensed therethrough in response to squeezing of the receptacle wall portion.

40. The squeeze container of claim 39 wherein the receptacle has an integral gasket portion at the lower end thereof, and the sleeve has a lower end with the integral gasket portion extending on the sleeve lower end, and a threaded connection between the cap and the sleeve with the cap configured so that with the cap loosened on or removed from the sleeve, the sleeve can be rotated about the receptacle and with the cap tightened down, the integral gasket will be clamped between the cap and the sleeve to keep the sleeve from being rotated about the receptacle.

41. The squeeze container of claim 40 wherein the cap has a flat bottom wall that is operable to clamp the integral gasket against the sleeve lower end with the cap tightened via the threaded connection with the sleeve and to stably support the container on a flat surface.

42. The squeeze container of claim 40 wherein the sleeve has a smaller diameter, lower annular portion having external threads for being threaded to internal threads of the cap, and a larger diameter annular portion having one of the indicia and the indicator thereon.

* * * * *